US007719511B2

(12) United States Patent
Huang

(10) Patent No.: US 7,719,511 B2
(45) Date of Patent: May 18, 2010

(54) DISPLAY APPARATUS WITH DYNAMIC BLINKING BACKLIGHT AND CONTROL METHOD AND DEVICE THEREOF

(75) Inventor: Jih-Fon Huang, Jhubei (TW)

(73) Assignee: Industrial Technology Research Institute, Hsinchu (TW)

( * ) Notice: Subject to any disclaimer, the term of this patent is extended or adjusted under 35 U.S.C. 154(b) by 1150 days.

(21) Appl. No.: 11/340,149

(22) Filed: Jan. 25, 2006

(65) Prior Publication Data

US 2007/0103424 A1 May 10, 2007

(30) Foreign Application Priority Data

Nov. 10, 2005 (TW) ..... 94139396 A

(51) Int. Cl.
*G09G 3/36* (2006.01)

(52) U.S. Cl. ..... 345/102

(58) Field of Classification Search ..... 345/87–104, 345/204

See application file for complete search history.

(56) References Cited

U.S. PATENT DOCUMENTS

| | | | | |
|---|---|---|---|---|
| 4,958,915 | A | 9/1990 | Okada et al. | 345/97 |
| 6,839,109 | B2 * | 1/2005 | Seiki et al. | 349/114 |
| 7,256,762 | B2 * | 8/2007 | Yang et al. | 345/102 |
| 7,450,104 | B2 * | 11/2008 | Baik | 345/102 |
| 2002/0154088 | A1 * | 10/2002 | Nishimura | 345/102 |
| 2003/0001813 | A1 * | 1/2003 | Sekiguchi | 345/96 |
| 2003/0227435 | A1 * | 12/2003 | Hsieh | 345/102 |
| 2004/0051692 | A1 | 3/2004 | Hirakata et al. | |
| 2004/0246242 | A1 | 12/2004 | Sasaki | 345/204 |

FOREIGN PATENT DOCUMENTS

| | | |
|---|---|---|
| CN | 1479520 | 3/2004 |
| CN | 1560679 | 1/2005 |
| JP | 2000-292767 | 10/2000 |

* cited by examiner

*Primary Examiner*—Regina Liang
(74) *Attorney, Agent, or Firm*—J.C. Patents

(57) ABSTRACT

A display apparatus with dynamic blinking backlights, a control method and a device thereof are provided. The dynamic blinking backlight control method for dynamically controlling the lighting status of the backlights of the display panel includes the following steps. First, the motion condition of a frame to be displayed on the display panel is detected for obtaining a motion detection result. The scanning frequency is determined in accordance with the motion detection result. Also, the lighting status of the backlights is controlled sequentially and respectively in accordance with the determined scanning frequency.

20 Claims, 3 Drawing Sheets

DISPLAY APPARATUS WITH DYNAMIC BLINKING BACKLIGHT AND CONTROL METHOD AND DEVICE THEREOF

CROSS-REFERENCE TO RELATED APPLICATION

This application claims the priority benefit of Taiwan application serial no. 94139396, filed on Nov. 10, 2005. All disclosure of the Taiwan application is incorporated herein by reference.

BACKGROUND OF THE INVENTION

1. Field of Invention

The present invention relates to a control method and device of a backlight. More particularly, the present invention relates to a control method and device of a dynamic blinking backlight.

2. Description of Related Art

As some types of display panels cannot emit light themselves, they need to be disposed with backlights. For example, liquid crystal displays (LCDs) need backlights for the aid of displaying frames. With considerable improvement of the viewing angle and significant reduction in price, the trend of LCDs replacing cathode ray tube (CRT) displays as computer screens has already developed. And its next ambition focuses on a broader market, the household television. To achieve dynamic image quality display rivaling the CRT display, various well-known LCD manufacturers have started exploring the improvement of the dynamic features of LCDs. Quality degradation of LCDs when displaying dynamic images includes: reduction in dynamic contrast, edge-blur, and stroboscopic motion. The main reason lies in that the response speed of the liquid crystal is slow and the so-called Hold-type data writing feature.

To reduce the influence of the Hold-type data writing feature, the applicable methods can be divided into two categories: image temporary interruption and non-image interruption. The former imitates the CRT display to temporarily interrupt the image, not being received by the visual system; while the later increases the data renewal speed or compensates the dynamic track. Though the blinking backlight is a basic method for improving the dynamic image quality, it causes worries about extra power consumption and decrease in the service life of the lamp.

U.S. Pat. No. 4,958,915 discloses a liquid crystal apparatus, including a method of making the low-level brightness of the blinking backlight synchronous with the period of writing data to the display panel. This conventional technology makes the backlight blink at a fixed frequency, so as to imitate the CRT display to temporarily interrupt the image, thereby improving the dynamic features of LCDs. However, keeping the backlight blinking at a fixed frequency will cause extra power consumption and shorten the service life of the lamp.

U.S. patent application Ser. No. 20020154088 discloses a transmissive-type liquid crystal display apparatus. This conventional technology determines the on-and-off time of the cold cathode lamp based on the parameters of dynamic images, so as to turn off all the cold cathode lamps in the vertical blank period of a frame period, thereby improving the dynamic features of LCDs. Therefore, as the cold cathode lamp is kept blinking at a fixed frequency, this conventional technology will also cause extra power consumption and shorten the service life of the cold cathode lamp.

U.S. patent application Ser. No. 20040246242 discloses a display apparatus. This conventional technology determines the on-and-off time of the cold cathode lamp in a frame period based on the parameters of dynamic images. In other words, the ratio of lightening time to darkening time of the cold cathode lamp in a frame period is determined by the movement amount of the dynamic images, thereby improving the dynamic features of LCDs. Therefore, as the cold cathode lamp is kept blinking at a fixed frequency, this conventional technology will also cause extra power consumption and shorten the service life of the lamp.

U.S. patent application Ser. No. 20040051692 discloses a liquid crystal display device. This conventional technology controls the brightness of the backlight by adjusting the time proportion of the lightening and the darkening period in accordance with the brightness information in the display signal. This conventional cold cathode lamp is kept blinking at a fixed frequency without the capability of dynamically adjusting the blinking frequency in accordance with the features of the displayed image. As the cold cathode lamp is kept blinking at a fixed frequency, it will cause extra power consumption and shorten the service life of the lamp.

SUMMARY OF THE INVENTION

Accordingly, one object of the present invention is to provide a dynamic blinking backlight control method. In accordance with the motion condition of a frame, the method dynamically determines the scanning frequency of the backlight or even stops the backlight from blinking so as to keep the backlight lit without blinking; various requirements such as improving dynamic image quality, reducing power consumption, and prolonging the service life of the backlight can be fulfilled.

Another object of the invention is to provide a dynamic blinking backlight control device, which fulfills the above objects by hardware architecture.

Yet another object of the invention is to provide a display apparatus with a dynamic blinking backlight, which reduces power consumption and improves image quality by modulating the light source of the display panel, especially by dynamically changing the lighting frequency of the backlight.

Based on the above and other objects, the present invention provides a dynamic blinking backlight control method, used for controlling the lighting status of multiple backlights of a display panel. The dynamic blinking backlight control method includes the following steps. First, the motion condition of a frame to be displayed on the display panel is detected to obtain a motion detection result. Then, the scanning frequency is determined in accordance with the motion detection result. Also, the lighting status of the backlights is controlled sequentially and respectively in accordance with the determined scanning frequency.

From another point of view, the present invention provides a dynamic blinking backlight control device. The dynamic blinking backlight control device includes a motion detection circuit, a control circuit, multiple backlights and a light source driving circuit. The motion detection circuit detects the motion condition of a frame to output a motion detection result. The control circuit is electrically connected to the motion detection circuit to determine the scanning frequency in accordance with the motion detection result. The light source required for displaying images on the display panel is provided by various backlights. The light source driving circuit is electrically connected to the control circuit and various backlights, wherein the lighting status of the backlights is controlled sequentially and respectively by the light source driving circuit in accordance with the scanning frequency determined by the control circuit.

The present invention provides another display apparatus with dynamic blinking backlight, which includes a display panel, a display driver, a motion detection circuit, a control circuit, multiple backlights, and a light source driving circuit. The display panel is used for displaying images. The display driver is electrically connected to the display panel to scan the display panel in accordance with the scanning frequency, and to drive the display panel to display the corresponding images in accordance with a frame. The motion detection circuit detects the motion condition of a frame to output the motion detection result. The control circuit, electrically connected to the motion detection circuit and the display driver, is used for determining the scanning frequency in accordance with the motion detection result. The light source required for displaying images on the display panel is provided by various backlights. The light source driving circuit is electrically connected to the control circuit and various backlights, wherein the lighting status of the backlights is controlled sequentially and respectively by the light source driving circuit based on the scanning frequency determined by the control circuit.

By modulating the light source of the display panel, especially by dynamically changing the lighting frequency of the backlights in accordance with the motion condition of a frame, and even by stopping blinking backlights and keeping the backlights lit without blinking, the present invention fulfills the various requirements of improving the dynamic image quality, reducing power consumption, and prolonging the service life of the backlight.

In order to the make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

DESCRIPTION OF EMBODIMENTS

Figure 1:
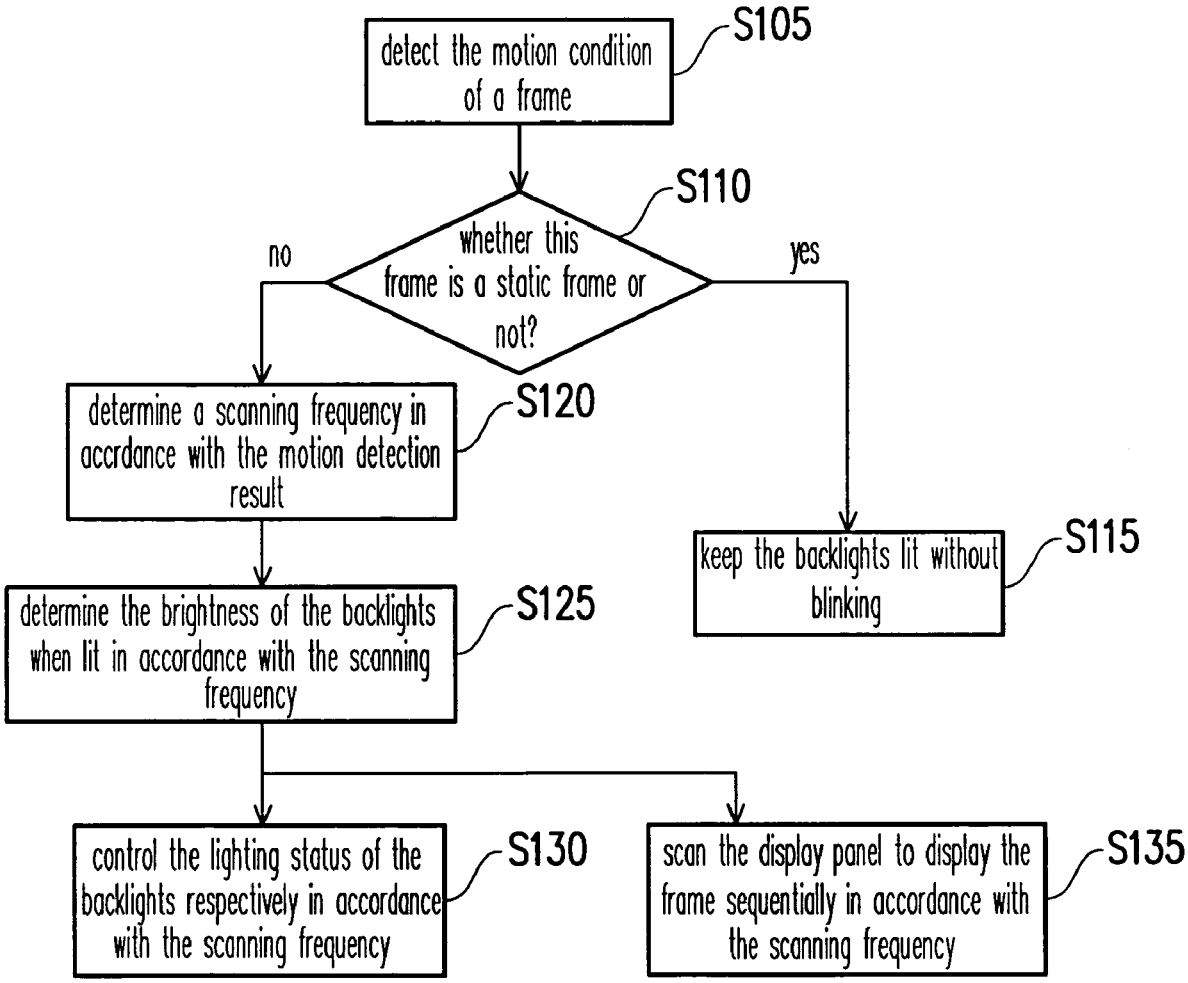
FIG. 1 is a flow chart illustrating a dynamic blinking backlight control method in accordance with an embodiment of the invention.

FIG. 1 is a flow chart illustrating a dynamic blinking backlight control method in accordance with an embodiment of the invention. Referring to FIG. 1, this dynamic blinking backlight control method is used to control the lighting status of multiple backlights of a display panel (for example, a liquid crystal display panel). First, step S105 is carried out, i.e., the motion condition of a frame to be displayed is detected to obtain a motion detection result. The aforementioned frame to be displayed will be displayed on a display panel.

Step S105 can be implemented by those skilled in the art in any ways. For example, compare the pixel data in the corresponding positions in the previously displayed frame and the frame to be displayed presently, obtain a differential pixel percentage in accordance with the changing proportion between both data, and take the differential pixel percentage as the motion detection result. Or, the motion detecting is carried out for the provided previously displayed frame and the frame to be displayed presently to obtain a motion vector as the motion detection result.

Then step S110 is carried out, wherein it is determined whether or not the frame is a static frame in accordance with the motion detection result. As the static frame does not need to imitate the CRT display to temporarily interrupt the image, the backlight is kept lit without blinking when the motion detection result shows that the frame is a static frame (step S115), thereby reducing the power consumption and prolonging the service life of the backlight.

When the motion detection result shows that the frame is a dynamic frame, steps S120 to S135 are carried out to improve the power consumption and image quality by modulating the light source of the display panel, especially by dynamically changing the lighting frequency of the backlight modular. This embodiment uses the motion detection result to activate the dynamic blinking backlight control mechanism, but it is not limited to this. For example, a button can be disposed. A user can press the button to send a command to activate (or turn off) the dynamic blinking backlight control mechanism, so as to perform steps S120 to S135. Or, the application (for example, a movie playing program) executed by a host (for example, a personal computer) generates a command when outputting (or stopping output) the dynamic images, so as to activate (or turn off) the dynamic blinking backlight control mechanism.

Figure 2A:
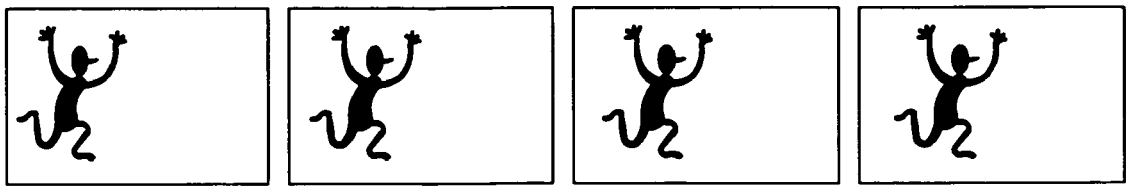
FIGS. 2A and 2B are schematic views illustrating respectively a slow moving frame and a quick moving frame.
Figure 2B:
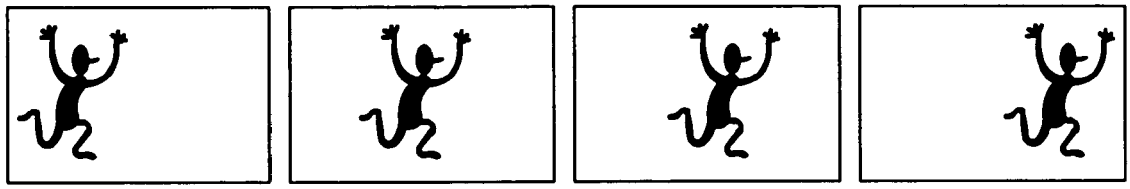

In step S120, the scanning frequency is determined in accordance with the motion detection result. Those skilled in the art can set a reference value to determine the scanning frequency in accordance with the relationship between the motion detection result and the reference value. To avoid an incorrect determination caused by the unexpected factors such as a few abruptly skipping images in the frame (for example, the quick motion of the mouse pointer), or to avoid the scanning frequency being switched too often, a hysteresis function can be added into step S120. For example, if the motion detection result is the above-mentioned differential pixel percentage, when the differential pixel percentage (i.e., the changing proportion of the frame) is larger than an upper limit value (for example, 10%) (showing that the frame is a quick moving frame, for example, as shown in FIG. 2B), the scanning frequency will be switched from a low frequency (for example, 60 Hz) to a high one (for example, 120 Hz) to improve the display quality of the frame. If the differential pixel percentage is smaller than a lower limit value (for example, 5%) (showing that the frame is a slow moving frame, for example, as shown in FIG. 2A), the scanning frequency will be switched from a high frequency back to a low one to reduce power consumption and to prolong the service life of the backlight. Or, when the number of successive times in which the differential pixel percentage is larger than an upper limit value reaches a predetermined number (for example, the differential pixel percentages of two successive frames are all larger than the upper limit value), the scanning frequency will be switched from a low frequency to a high one. And when the number of successive times in which the differential pixel percentage is smaller than a lower limit value reaches a predetermined number, the scanning frequency will be switched from a high frequency back to a low one. Furthermore, if the motion detection result is represented by the motion vector, its operating steps can also refer to the above description.

Figure 3:
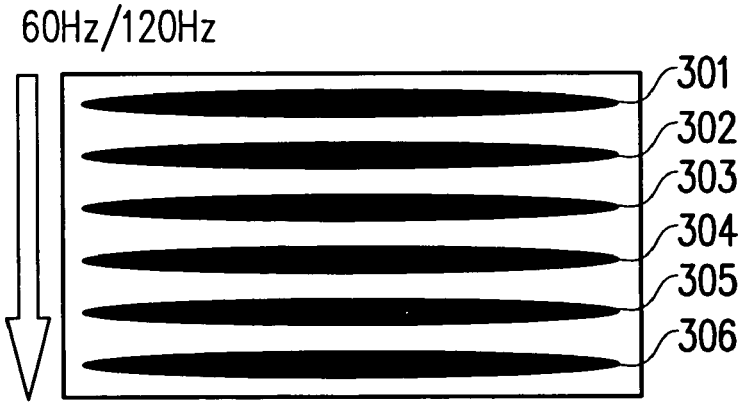
FIG. 3 is a schematic example illustrating the dynamic scanning backlight control in accordance with the invention.

In this embodiment, the backlight is, for example, a cold cathode fluorescent lamp (CCFL) or a light-emitting diode (LED), with its manner of arrangement shown in FIG. 3. In FIG. 3, the backlights 301-306 are disposed at the back of the display panel along the direction of a scan line of the display panel. When the dynamic blinking backlight control mechanism is activated, the averaged brightness of the backlight will be reduced. In step S125, the brightness of every backlight when it is lit will be increased in accordance with the scanning frequency, so as to compensate the averaged brightness of the backlight.

In step S130, the lighting status of the backlights 301-306 is controlled respectively in accordance with the scanning frequency determined in step S120 and the brightness determined in step S125. For example, when the scanning frequency is determined to be 60 Hz or 120 Hz, as shown in FIG. 3, at least one of the backlights 301-306 is lit in accordance with the determined scanning frequency and the other backlights are turned off. Of course, the backlights 301-306 can also be lit, turned off or kept blinking at the same time in accordance with the determined scanning frequency.

This embodiment continues to carry out step S135 after finishing step S125, i.e., the scanning frequency determined by Step S120 is used to scan the display panel, so as to make the display panel display the corresponding images in accordance with the frame. Therefore, the display panel and the backlights can be scanned synchronously to display the frame, thereby improving the frame display quality.

Figure 4:
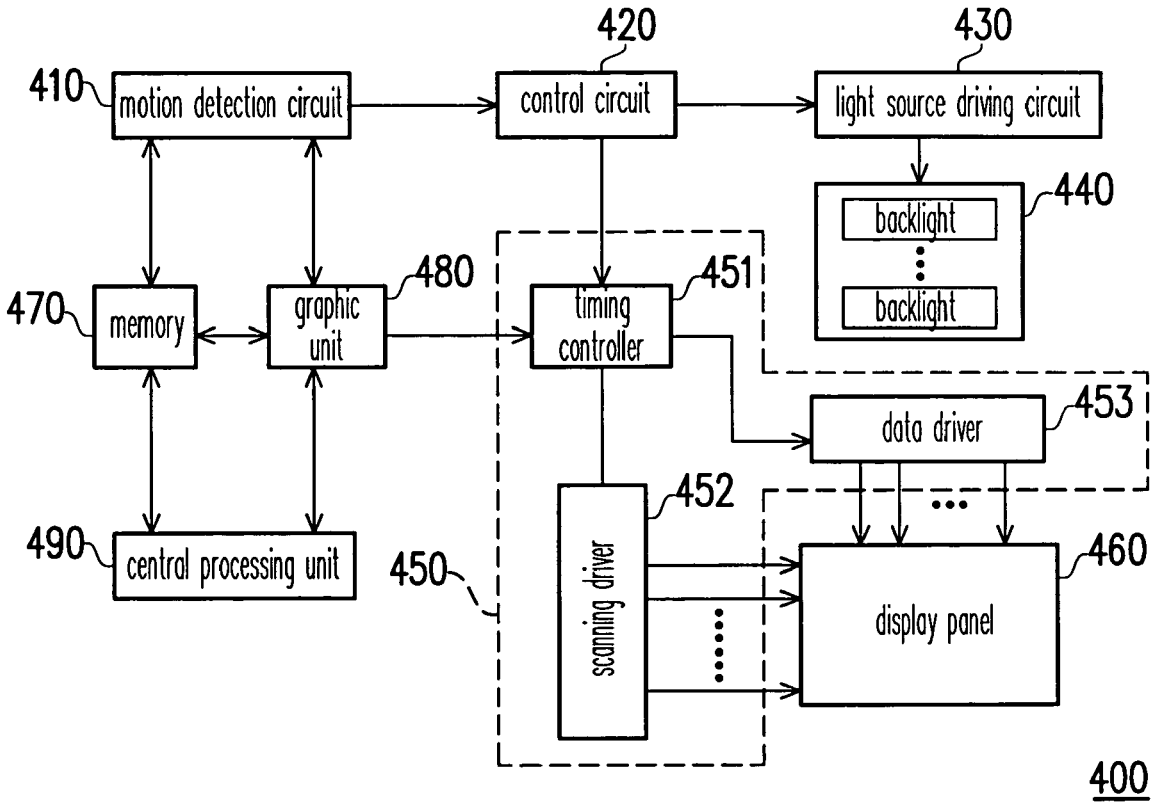
FIG. 4 is a block view illustrating a display apparatus with dynamic blinking backlight in accordance with the embodiment of the invention.

FIG. 4 is a block diagram illustrating a display apparatus with dynamic blinking backlight in accordance with the embodiment of the invention. Referring to FIG. 4, the display apparatus 400 includes a dynamic blinking backlight control device, a display driver 450, a display panel 460, a memory 470, and a graphic unit 480. The dynamic blinking backlight control device includes a motion detection circuit 410, a control circuit 420, a light source driving circuit 430, and backlights 440. In this embodiment, the display panel 460 is, for example, liquid crystal display panel, and the backlights 440 can be composed by CCFLs or LEDs. The backlights 440 can be disposed at the back of the display panel 460 in accordance with the arrangement as shown in FIG. 3.

A central processing unit (CPU) 490 is electrically connected to the memory 470 and the graphic unit 480. The graphic unit 480 continuously outputs frames to carry out the graphic operation based on the control of the CPU 490. The graphic unit 480 is not only transmitted to the motion detection circuit 410, but is also stored in the memory 470 at the same time. The motion detection circuit 410 compares the presently displayed frame output by the graphic unit 480 and the previously displayed frame stored in the memory 470 to detect the motion condition of the frame, and accordingly outputs the motion detection result to the control circuit 420. The control circuit determines the scanning frequency in accordance with the motion detection result output by the motion detection circuit 410.

Those skilled in the art can implement the motion detection circuit 410 by any means. For example, the motion detection circuit 410 compares the pixel data in the corresponding positions in the previously displayed frame and the frame to be displayed presently to obtain a differential pixel percentage in accordance with the changing proportion between both data, and take the differential pixel percentage as the motion detection result. Or, the motion detection circuit 410 carries out the motion detection for the previously displayed frame and the frame to be displayed presently to obtain a motion vector as the motion detection result.

The control circuit 420 is electrically connected to the motion detection circuit 410. The control circuit 420 determines whether the frame to be displayed on the display panel 460 is a static frame in accordance with the motion detection result output by the motion detection circuit 410. As the static frame needs not to imitate the CRT display to temporarily interrupt the image, when the motion detection result shows that the frame is a static frame, the control circuit 420 keeps the backlights 440 lit without blinking via the light source driving circuit 430, thereby reducing power consumption and prolonging the service life of the backlights.

When the motion detection result output by the motion detection circuit 410 shows that the frame is a dynamic frame, the power consumption can be reduced and image quality can be improved by modulating the light source of the display panel, i.e., the control circuit 420 dynamically changes the lighting frequency of the backlight 440 via the light source driving circuit 430. This embodiment uses the motion detection result to activate the dynamic blinking backlight control mechanism, but it is not limited to this. For example, a button can be disposed. A user can press the button to send out a command to activate (or turn off) the mechanism, so as to carry out dynamic blinking backlight control. Or, the application (for example, a movie playing program) executed by a host (for example, a personal computer) generates a command when outputting (or stopping output) the dynamic images, so as to activate (or turn off) the dynamic blinking backlight control mechanism.

Then, the control circuit 420 determines the scanning frequency in accordance with the motion detection result. Those skilled in the art can set a reference value to determine the scanning frequency based on the relationship between the motion detection result and the reference value. To avoid the incorrect determination caused by the unexpected factors such as a few abruptly skipping images in the frame (for example, the quick motion of the mouse pointer), or to avoid the scanning frequency being switched too often, a hysteresis function can be added to the control circuit 420. For example, if the motion detection result is the above-mentioned differential pixel percentage, when the differential pixel percentage (i.e., the changing proportion of the frame) is larger than an upper limit value (for example, 10%) (showing that the frame is a quick moving frame, for example, as shown in FIG. 2B), the scanning frequency will be switched from a low frequency (for example, 60 Hz) to a high one (for example, 120 Hz) to improve the display quality of the frame. If the differential pixel percentage is smaller than a lower limit value (for example, 5%) (showing that the frame is a slow moving frame, for example, as shown in FIG. 2A), the scanning frequency will be switched from a high frequency back to a low one, so as to reduce the power consumption and to prolong the service life of the backlights. Or, when the number of successive times in which the differential pixel percentage is larger than an upper limit value reaches a predetermined number (for example, the differential pixel percentages of two successive frames are larger than the upper limit value), the scanning frequency will be switched from a low frequency to a high one. And when the number of successive times in which the differential pixel percentage is smaller than a lower limit value reaches a predetermined number, the scanning frequency will be switched from a high frequency back to a low one. Furthermore, if the motion detection result is represented by a motion vector, its operating manner can also refer to the above description.

When the control circuit 420 activates the dynamic blinking backlight control mechanism, the averaged brightness of the backlights will be reduced. The control circuit 420 will raise the brightness of the backlights 440 when they are lit via the light source driving circuit 430 in accordance with the determined scanning frequency, so as to compensate the averaged brightness of the backlights. The control circuit 420 controls the lighting status of the backlights 440 respectively via the light source driving circuit 430 in accordance with the determined scanning frequency and brightness. For example, when the scanning frequency is 60 Hz or 120 Hz as shown in FIG. 3, at least one of the backlights 301-306 is lit in accordance with the determined scanning frequency and the other backlights are turned off. Of course, the backlights 301-306 (i.e., the backlights 440 in FIG. 4) can also be lit, turned off, or kept blinking at the same time in accordance with the determined scanning frequency.

The display driver 450 is electrically connected to the display panel 460 to scan the display panel 460 based on the scanning frequency determined by the control circuit 420, and to drive the display panel 460 to display the corresponding images in accordance with the frame. In this embodiment, the display driver 450 includes a timing controller 451, a scanning driver 452 and a data driver 453. The timing controller 451 is electrically connected to the graphic unit 480 to receive the frame to be displayed presently. The timing controller 451 is further electrically connected to the control circuit 420 to scan the display panel 460 via the scanning driver 452 based on the scanning frequency determined by the control circuit 420. The data driver 453 cooperates with the scanning timing of the scanning driver 452 to transmit the scan line data to the display panel 460 to display the frame.

In sum, by modulating the light source of the display panel, especially by dynamically changing the lighting frequency of the backlights in accordance with the motion condition of a frame, and even by stopping blinking backlights and keeping the backlights lit without blinking, the present invention fulfils the various requirements of improving dynamic image quality, reducing power consumption and prolonging the service life of the backlights.

Though the present invention has been disclosed above by the preferred embodiments, it is not intended to limit the invention. Anybody skilled in the art can make some modifications and variations without departing from the spirit and scope of the invention. Therefore, the range of protection of the invention shall be defined by the appended claims.

What is claimed is:

1. A dynamic blinking backlight control method for controlling the lighting status of multiple backlights of a display panel, comprising:

detecting the motion condition of a frame to obtain a motion detection result, wherein the display panel displays images in accordance with the frame;

determining a scanning frequency in accordance with the motion detection result; and controlling the lighting status of the backlights sequentially and respectively in accordance with the scanning frequency.

2. The dynamic blinking backlight control method as claimed in claim 1, wherein the steps of detecting the motion condition of the frame comprise:

providing a previously displayed frame;

comparing the pixel data in the corresponding position of the previously displayed frame and the frame to be displayed presently, to obtain a differential pixel percentage; and obtaining the motion detection result in accordance with the differential pixel percentage.

3. The dynamic blinking backlight control method as claimed in claim 2, wherein the steps of determining the scanning frequency comprise:

determining the scanning frequency as a high frequency when the differential pixel percentage shown in the motion detection result is larger than an upper limit value; and determining the scanning frequency as a low frequency when the differential pixel percentage is smaller than a lower limit value.

4. The dynamic blinking backlight control method as claimed in claim 1, wherein the steps of controlling the lighting status of the backlights sequentially include:

disposing the backlights at the back of the display panel along the direction of a scan line of the display panel; and lighting at least one of the backlights sequentially in accordance with the scanning frequency, and turning off the other backlights.

5. The dynamic blinking backlight control method as claimed in claim 1, further comprising:

keeping the backlights lit without blinking when the motion detection result shows that the frame is a static frame.

6. The dynamic blinking backlight control method as claimed in claim 1, further comprising:

determining the brightness of the backlights when they are lit in accordance with the scanning frequency; and keeping the backlights lit without blinking in accordance with a command.

7. The dynamic blinking backlight control method as claimed in claim 6, wherein the command is generated by a button.

8. The dynamic blinking backlight control method as claimed in claim 6, wherein the command is generated by an application executed by a host, and the host enables the display panel to display corresponding images by outputting the frame.

9. A dynamic blinking backlight control device, comprising:

a motion detection circuit, used for detecting the motion condition of a frame to output a motion detection result;

a control circuit, electrically connected to the motion detection circuit, used for determining a scanning frequency in accordance with the motion detection result;

multiple backlights, used for providing the desired light source for a display panel to display images; and a light source driving circuit, electrically connected to the control circuit and the backlights, wherein the light source driving circuit controls the lighting status of the backlights sequentially and respectively in accordance with the scanning frequency determined by the control circuit.

10. The dynamic blinking backlight control device as claimed in claim 9, wherein the control circuit is further electrically connected to a timing controller, and the timing controller scans the display panel via a scanning driver based on the scanning frequency determined by the control circuit.

11. The dynamic blinking backlight control device as claimed in claim 9, further comprising:

a memory, used for storing and providing the previously displayed frame;

wherein, the motion detection circuit further electrically connected to the memory is used for comparing the pixel data in the corresponding position in the previously displayed frame and the frame to be displayed presently, thereby outputting a differential pixel percentage; and the control circuit determines the scanning frequency in accordance with the differential pixel percentage.

12. The dynamic blinking backlight control device as claimed in claim 11, wherein when the differential pixel percentage output by the motion detection circuit is larger than an upper limit value, the control circuit determines the scanning frequency is a high frequency; and when the differential pixel percentage output by the motion detection circuit is smaller than a lower limit value, the control circuit determines the scanning frequency is a low frequency.

13. The dynamic blinking backlight control device as claimed in claim 9, wherein the backlights are disposed at the back of the display panel along the direction of a scan line of the display panel; and the light source driving circuit lights at least one of the backlights via the scanning frequency determined by the control circuit and turns off the other backlights.

14. The dynamic blinking backlight control device as claimed in claim 9, wherein when the motion detection result of the motion detection circuit shows that the frame is a static frame, the control circuit keeps the backlights lit without blinking by controlling the light source driving circuit.

15. The dynamic blinking backlight control device as claimed in claim 9, wherein the control circuit further receives a command and keeps the backlights lit without blinking by controlling the light source driving circuit in accordance with the command.

16. The dynamic blinking backlight control device as claimed in claim 15, wherein the command is generated by a button.

17. The dynamic blinking backlight control device as claimed in claim 15, wherein the command is generated by an application executed by a host, and the host enables the display panel to display corresponding images by outputting the frame.

18. The dynamic blinking backlight control device as claimed in claim 9, wherein the control circuit further determines the brightness of the backlights when they are lit via controlling the light source driving circuit in accordance with the scanning frequency.

19. A display apparatus with dynamic blinking backlight, comprising:

a display panel, for displaying images;

a display driver, electrically connected to the display panel, scans the display panel in accordance with a scanning frequency, and drives the display panel in accordance with a frame to display corresponding images;

a motion detection circuit, used for detecting the motion condition of the frame to output a motion detection result;

a control circuit, electrically connected to the motion detection circuit and the display driver, determines the scanning frequency in accordance with the motion detection result;

multiple backlights, used for providing the desired light source for the display panel to display images; and a light source driving circuit, electrically connected to the control circuit and the backlights, wherein the light source driving circuit controls the lighting status of the backlights sequentially and respectively in accordance with the scanning frequency determined by the control circuit.

20. The display apparatus with dynamic blinking backlight as claimed in claim 19, further comprising:

a memory, used for storing and providing the previously displayed frame; wherein the motion detection circuit further electrically connected to the memory is used for comparing the pixel data in the corresponding position in the previously displayed frame and the frame to be displayed presently, thereby outputting a differential pixel percentage;

when the differential pixel percentage output by the motion detection circuit is larger than an upper limit value, the control circuit determines the scanning frequency is a high frequency;

when the differential pixel percentage output by the motion detection circuit is smaller than a lower limit value, the control circuit determines the scanning frequency is a low frequency;

the light source driving circuit lights at least one of the backlights sequentially in accordance with the scanning frequency determined by the control circuit, and turns off the other backlights; and when the motion detection result of the motion detection circuit shows that the frame is a static frame, the control circuit keeps the backlights lit without blinking by controlling the light source driving circuit.

* * * * *